United States Patent [19]

Seiriki et al.

[11] Patent Number: 4,967,677

[45] Date of Patent: Nov. 6, 1990

[54] COMPOSITE SEWING MACHINE WITH SINGLE NEEDLE FOR LOCK AND OVERLOCK STITCHES

[75] Inventors: Matsuzo Seiriki, Shijyonawate; Shogo Hasegawa, Ibaraki, both of Japan

[73] Assignee: Hosei Mishin Seizo Kabushiki Kaisha, Higahiosaka, Japan

[21] Appl. No.: 293,008

[22] Filed: Jan. 3, 1989

[51] Int. Cl.[5] ..... D05B 1/20; D05B 57/06

[52] U.S. Cl. ..... 112/168; 112/162; 112/199; 112/221; 112/288

[58] Field of Search ..... 112/168, 288, 221, 162, 112/199

[56] References Cited

U.S. PATENT DOCUMENTS

| | | | |
|---|---|---|---|
| 4,267,786 | 5/1981 | Hanyu et al. | 112/168 |
| 4,690,080 | 9/1987 | Mikuni et al. | 112/168 X |
| 4,799,439 | 1/1989 | Koshinaka et al. | 112/168 X |

FOREIGN PATENT DOCUMENTS

| | | |
|---|---|---|
| 53-67551 | 6/1978 | Japan . |
| 60-3805 | 2/1985 | Japan . |
| 60-20369 | 6/1985 | Japan . |
| 61-26392 | 6/1986 | Japan . |

*Primary Examiner*—Andrew M. Falik

*Attorney, Agent, or Firm*—Wenderoth, Lind & Ponack

[57] ABSTRACT

A composite sewing machine has a lock stitch mechanism and an over-lock stitch mechanism. A switching mechanism is connected to the stitching mechanisms for switching the operation of the sewing machine between a lock stitch operation and an over-lock stitch operation. The machine has a single needle carrying element, a needle position converter for changing the position of the needle carrying element laterally of the stitching direction and including a needle bar connecting stud engaging the needle carrying element and a fulcrum shaft on which the stud is rotatably mounted for pivotal movement to change the vertical orientation of the needle carrying element between a lock stitch position and an over-lock stitch position which are adjacent to each other and juxtaposed laterally on the sewing machine. The over-lock stitch mechanism has an upper looper and a lower looper at the over-lock stitch position, a looper driving mechanism connected to the loopers and including a clutch connecting the driving mechanism to the over-lock stitch mechanism, whereby one needle is adapted to be used for both lock stitching and over-lock stitching.

10 Claims, 5 Drawing Sheets

COMPOSITE SEWING MACHINE WITH SINGLE NEEDLE FOR LOCK AND OVERLOCK STITCHES

BACKGROUND OF THE INVENTION

The present invention relates to a composite sewing machine in which there is provided in one sewing machine a lock stitch mechanism for carrying out straight stitching, zigzag stitching, pattern stitching and the like and an over-lock stitch mechanism used mainly for cloth hemstitching so that lock stitching and over-lock stitching can be selectively performed by activating switching means.

PRIOR ART

A composite sewing machine, in which there is provided in one sewing machine a lock stitch mechanism, an over-lock stitch mechanism and switching means so that the respective mechanisms can be selectively used for lock stitching and over-lock stitching, has been disclosed in Japanese Patent Laid-Open Gazette No. Sho 53-67551, Utility Model Publication Gazette No. Sho 60-3805, Utility Model Publication Gazette No. 60-20369 and Patent Publication Gazette No. Sho 61-26392.

Since the conventional composite sewing machine is provided on, for example, an arm mounting portion with the needle position of the over-lock stitch mechanism separate from the needle position of the lock stitch mechanism for carrying out the stitching at the fore end of an arm of the sewing machine, the lock stitch mechanism and over-lock mechanism have in common only an upper shaft, so that upper members, such as a needle, a needle bar, a needle bar connecting stud and a presser plate, and driving mechanisms therefor and lower members, such as a throat plate and a cloth feed mechanism, must be provided separately for each system, thereby making the machine expensive to produce. Also, since both the mechanisms are separate from each other at the stitching position, it is inconvenient during use to move them to the selected stitching position. Furthermore, since the momentum of each member changes depending on the kind of stitching, it is necessary to provide complex mechanisms.

Meanwhile, for a household sewing machine provided with a straight stitch mechanism and zigzag stitch mechanism to perform straight stitching, pattern stitching or buttonholing, the user may desire to perform further higher stitching so as to increase demand for an over-lock sewing machine, so that it is important to improve the composite sewing machine so that it can be operated the same as the usual household sewing machine.

OBJECT AND BRIEF SUMMARY OF THE INVENTION

It is an object of the present invention to provide a composite sewing machine which in one sewing machine has a lock stitch mechanism and an over-lock stitch mechanism. To this end, the machine is provided with switching means for switching the stitching operation of the sewing machine into a lock stitch or the over-lock stitch mode of operation, and a needle position converter which supports a needle bar connecting stud by a fulcrum shaft to change the vertical position of a needle bar, thereby laterally changing the stitch needle position. In the machine of the invention, the lock stitch position and over-lock stitch position are adjacent to each other and juxtaposed on the bed of the sewing machine in a range of amplitude of the needle position controlled by the needle position converter, and an upper looper and a lower looper of the over-lock stitch mechanism are provided at the over-lock stitch position, and a clutch is connected to the stitch switching means and a looper driving mechanism connected between a looper driving shaft for driving the upper and lower loopers and the lower shaft of the sewing machine, whereby one common needle can be used for both lock stitching and over-lock stitching.

BRIEF DESCRIPTION OF THE DRAWINGS

The drawings show an embodiment of the invention in which.

DETAILED DESCRIPTION OF THE INVENTION

Figure 1:
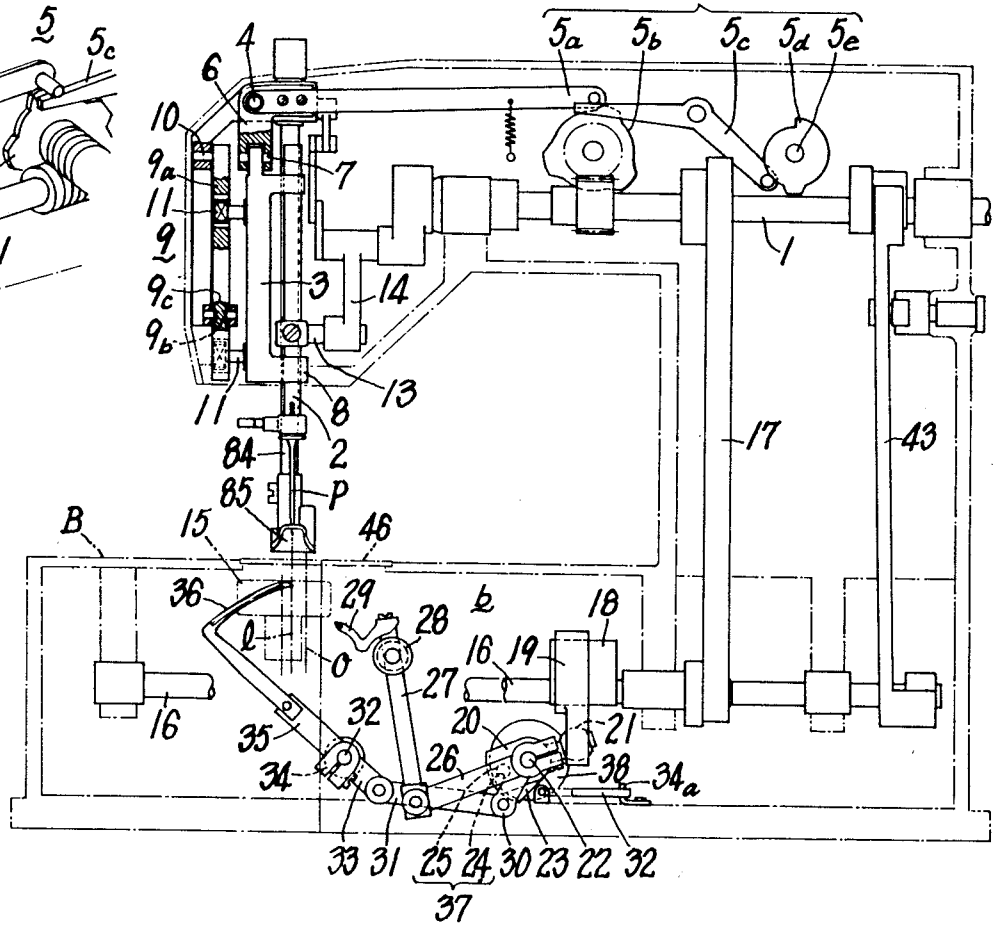
FIG. 1 is a front view partly in section showing the construction of the machine of the invention.
Figure 2:
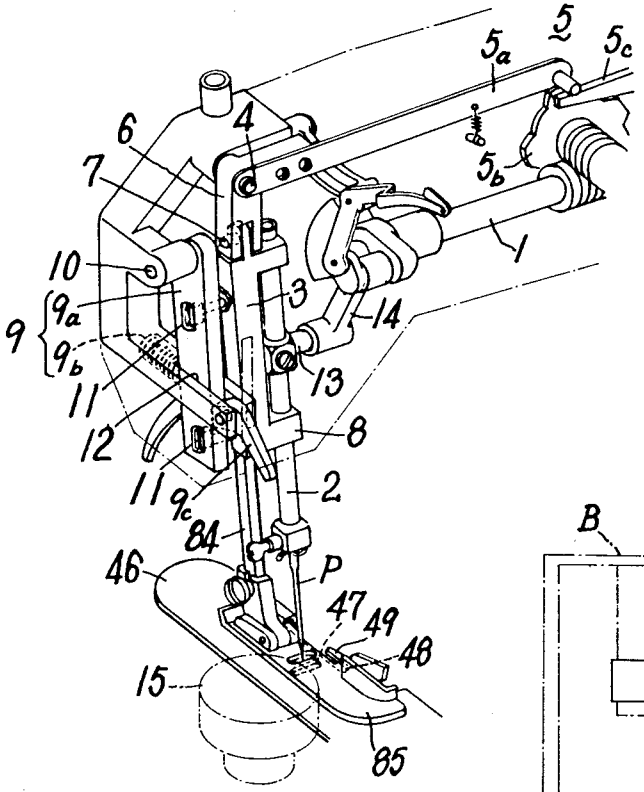
FIG. 2 is a partially cutaway perspective view showing the structure in the vicinity of a needle bar.
Figure 5:
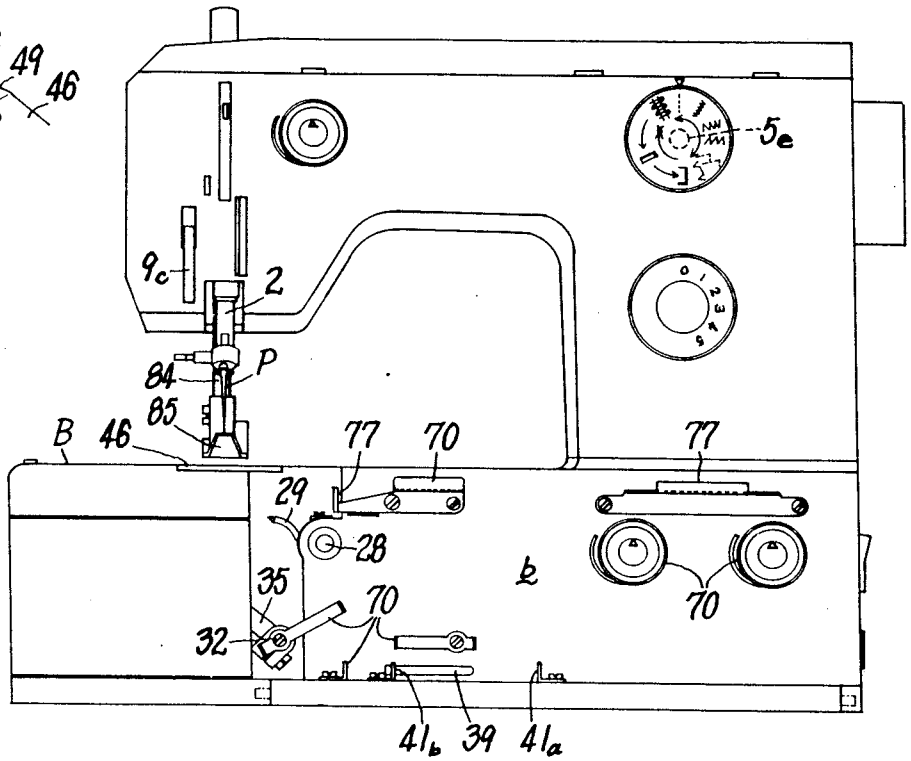
FIG. 5 is a front view of the sewing machine of the invention.
Figure 4:
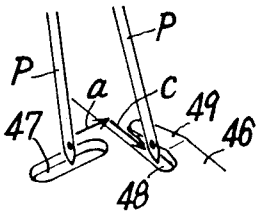
FIG. 4 is a partially cutaway perspective view showing the lock stitch position and over-lock stitch position of the needle.
Figure 3:
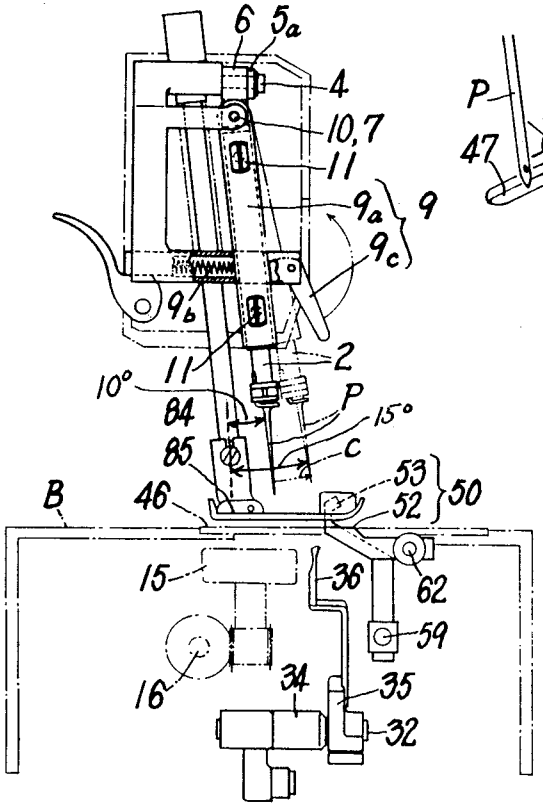
FIG. 3 is a left side view of the structure of FIG. 3.

An embodiment of the invention shown in the drawings moves the needle position laterally (rightwardly) to a maximum by a needle position converter and laterally to the over-lock stitch position from the lock stitch position, and furthermore a needle bar and the needle are inclined to move the needle position forwardly, thereby moving the needle to the over-lock stitch position.

The embodiment moves the needle position in two lateral and longitudinal directions, thereby occupying a wide space in which the lower members can be positioned, especially enabling a horizontal full-rotary hook to be used for locking stitching. For this purpose, in addition to the needle position converter for laterally switching the needle position, needle bar inclining means for longitudinally moving the needle position and auxiliary means for holding a needle bar connecting stud at a lock stitch angle and an over-lock stitch angle are provided.

Next, this embodiment will be described in connection with the drawings.

In the drawings, 1 designates an upper shaft of the sewing machine driven by a motor M, 2 designates a needle bar connected to the free end of the upper shaft 1 so as to rise and fall, and has at the lower end a needle P. A needle bar supporting stud 3 vertically movably supports the needle bar and is movable for moving the needle position laterally of the sewing machine on a first fulcrum shaft 4. A needle position converter 5 is provided between the intermediate portion of the upper shaft 1 and the needle bar connecting stud 3 is used for both straight stitching and zigzag stitching. The needle position converter 5 has a construction about the same as well-known ones and comprises a swinging lever 5*a* rigidly connected to the needle bar connecting stud 3, a zigzag motion generation cam 5*b* for swinging the swinging lever 5*a* and associated with the upper shaft 1 to be driven therefrom, a switching lever 5*c* for separating the swinging lever 5*a* from the zigzag motion generating cam 5*b*, a needle position converting cam 5*d* for actuating the switching lever 5*c*, and a pattern selection cam shaft 5*e* fixed to the cam 5*d*.

The needle position converter 5, when the pattern selection cam shaft 5*e* is rotated to the indicated position, the crest of the needle position converting cam 5*d* contacts the switching lever 5*c*, and the needle bar connecting stud 3 and needle bar 2 are given the maximum rightward movement by the swing lever 5*a* pivoting on fulcrum shaft 4, so that the needle P is moved laterally in direction from the lock stitch position l to the over-lock stitching line 0.

The needle bar connecting stud 3 comprises an upper member 6 having the upper end on the fulcrum shaft 4 and a lower member 8 connected to the lower end of the upper member 6 through a second fulcrum shaft 7 horizontally inserted thereto and vertically movably supporting the needle bar connecting stud 3. Inclining means 9 is provided for inclining the needle bar 2 around the second fulcrum shaft 7 as the fulcrum. The inclining means further increases inclination of the needle bar connecting stud 3 so as to position the needle bar 2 and the lower end of needle P after it has been moved from the lock stitch position l to the over-lock stitch line O, thereby causing the needle P to advance in direction C to a predetermined position on the over-lock stitch line O.

Inclining means 9 is provided for assisting the lateral movement a and inclining movement c of the needle bar connecting stud 3 to hold the stud 3 at a lock stitch angle and an over-lock stitch angle. The auxiliary means 9 has a regulating bar 9*a* provided along the left side surface of the needle bar connecting stud 3 and for changing the inclination of the stud 3, a spring 9*b* is provided for always biasing the regulating bar 9*a* toward the over-lock stitch position, and a switching cam lever 9*c* is provided for supporting the regulating bar 9*a* at a predetermined angle against the force of spring 9*b*.

The regulating bar 9*a* is hinged at the upper end on a fulcrum shaft 10 with an axis nearly coincident with the second fulcrum shaft 7 on the needle bar connecting stud 3, and hangs down along lower member 8, and upper and lower guide pins 11 projecting from the side surface of lower member 8 of the needle bar connecting stud 3 engage in slots in regulating bar 9*a*, whereby the stud 3 is inclined at the same angle as the regulating bar 9*a*. The lower end of regulating bar 9*a* is fitted into a slit 12 formed in the arm of the sewing machine, and switching cam lever 9*c* is pivoted to the front end of slit 12, and, when turned downwardly, holds the regulating bar 9*a* and the needle bar connecting stud 3 at the lock stitch angle, and, when turned upwardly, allows the spring 9*b* to push the lower end of regulating bar 9*a* out so as to hold the needle bar connecting stud 3 and needle bar 2 at the over-lock stitch angle.

In addition, a proper clearance is formed between a needle bar crank rod 13 and a needle bar crank 14, so that when the needle bar 2 is moved to the over-lock stitch position it will smoothly rise and fall. The angle of the sewing needle to the vertical lock stitch position is 10° and the angle at the over-lock stitch is 15°, but the former angle may be 0° and the needle bar may be inclined only when in the over-lock stitching position. Also, the embodiment uses a horizontal full-rotary hook 15 for the lock stitching, but the present invention may provide a front cup merely by changing the needle position slightly.

A lower shaft 16 is driven from the upper shaft 1 through a timing belt 17, and a looper cam 18 is fixed to an intermediate portion of the lower shaft 16. A lifting rod 19 is fitted onto the looper cam 18 and lifts following the rotation of lower shaft 16. A crank 20 is connected to the lifting rod 19 through a universal joint 21 fitted on the lower portion of lifting rod 19 and is mounted at the base onto a looper shaft 22 horizontally journalled within the bed B and extending perpendicularly to the lower shaft 16. A driven crank 23 in contact with the side surface with the crank 20 is fixed to the looper shaft 22, and connecting bores 24 are formed in the driven crank 23 and crank 20 and extending in parallel to the looper shaft 22, and a connecting pin 25 fitted slidably into the connecting bores 24.

When the connecting pin 25 is positioned in the connecting bores 24, the driven crank 23 is connected to the crank 20 to transmit the swinging motion of crank 20 for half reciprocation rotation of the looper shaft 22. An upper looper crank 26 is fixed at one end to the looper shaft 22, and an upper looper rod 27 is connected at the lower end to the free end of upper looper crank 26 and held at an intermediate portion in a rotary bearing 28. An upper looper 29 is fixed to the upper end of upper looper rod 27 and swings laterally while vertically moving together with the half rotation of the looper shaft 22. A lower looper crank 30 is separately fixed to the looper shaft 22, and a connecting rod 31 is connected at one end to the free end of lower looper crank 30. A lower looper shaft 32 is journalled in a bearing 34 on the lever 33 connected at the free end to the other end of connecting rod 31, and a lower looper rod 35 is fixed at the lower end to the lower looper shaft 32 and carries at the upper end a falcate lower looper 36 so as to swingably reciprocate during the rotation of looper shaft 22. The upper looper 29 and lower looper 36 are provided at the positions where they cooperate with the needle P which has been moved to a needle position on the over-lock stitch line O on which the needle position when the converting cam 5*d* engages with the switching lever 5*c* and the needle bar connecting stud 3 changes the needle position rightwardly to a maximum by pivoting on the fulcrum shaft 4.

A clutch 37 is comprised of the connecting pin 25, pin carriers 38 fixed to the outer end of the connecting pin 25 and freely fitted on the looper shaft 22, and a clutch operating lever 39 slidably mounted at the bottom of the bed B and slidable parallel to the looper shaft 22. The clutch 37 constitutes switching means for switching to the overlock stitch condition in which the connecting pin 25 connects the crank 20 with the driven crank 23 to transmit the rotation of lower shaft 16 to the looper shaft 22 from the lock stitch condition in which the connecting pin 25 is retracted so that the driven crank 23 does not move with the crank 20.

Figure 6:
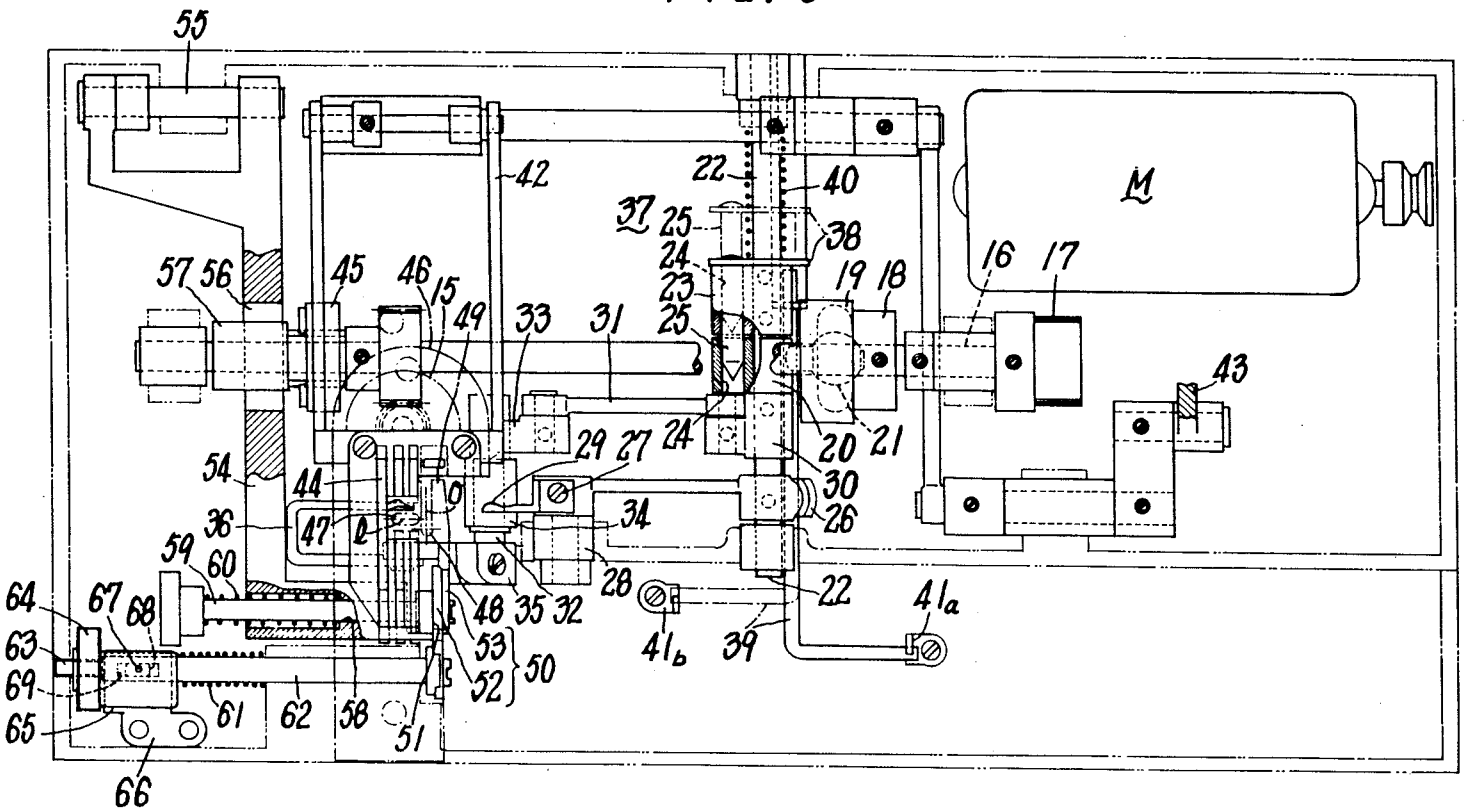
FIG. 6 is a plan view schematically showing the structure of the bed.
Figure 7:
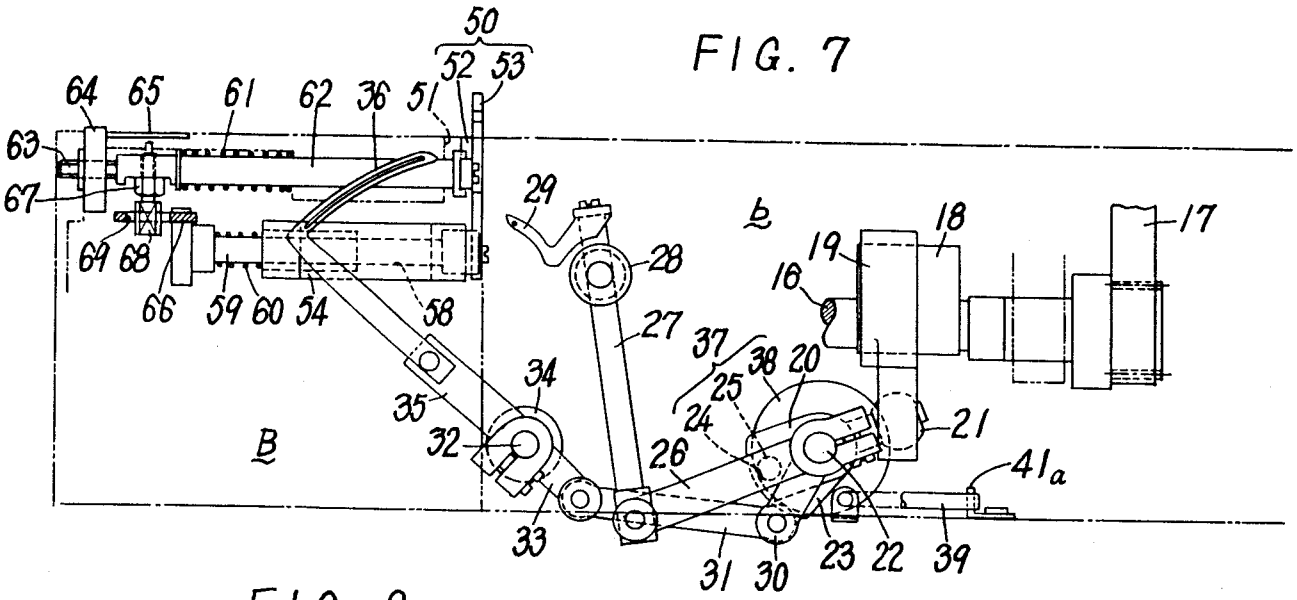
FIG. 7 is a front view showing the structure of a looper portion.

A compression spring 40 biases the pin carrier 38 toward the driven crank 23. One stopper 41*a* is provided for holding the clutch operating lever 39 in the clutch coupling position, and another stopper 41*b* is provided for holding the clutch operating lever in the non-coupling position (shown by the phantom line in FIG. 6).

A cloth feed table 42 is connected to a bifurcate rod 43 in the bed B and longitudinally reciprocate feed teeth at the fore end and is moved vertically by a cloth feed cam 45 fixed to the lower shaft 16.

A throat plate 46 is disposed above the feed teeth 44 and is mounted on the bed surface. The throat plate 46 has an elongate needle hole 47 for lock stitching through which the needle P vertically moves when lock stitching is performed, and a needle hole 48 for over-lock stitching through which the needle P in the changed needle position moves vertically when over-lock stitching is performed, the hole 48 being disposed to the right-hand side of the hole 47. A loop forming plate 49 for over-lock stitching is formed on the side edge of the throat plate 46.

Figure 8:
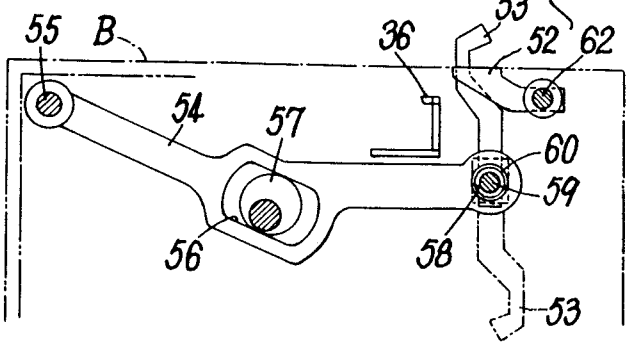
FIG. 8 is a schematic side view of a knife unit.

A knife unit 50 for evenly trimming the fabric edge or edges preparatory to and over-lock stitching comprising a stationary knife 52 and a vertically movable knife 53 is provided in a cutout 51 in the vicinity of the rise and fall position of the needle P and of the setting position of the lower looper 36. A lift actuating arm 54 for the knife unit 50 is provided at the back of the bottom of bed B on a support shaft 55, and a cam 57 fixed to the lower shaft 16 is fitted into an opening 56 at an intermediate portion of the arm 54 as shown in FIG. 8, whereby the arm 54 can be swung around shaft 55. The vertically movable knife 53 is mounted at one end of a slide shaft 59 extending through a tubular shaft 58 at the free end of the lift actuating arm 54 and can be rotated into the bed to the position as shown by the phantom line in FIG. 8 by pushing out and rotating the slide shaft 59 against a coil spring 60 fitted therein, whereby the knife 53 moves to a position where it does not hinder the lock stitching.

The stationary knife 52 is mounted on one end of another slide shaft 62 containing therein a coil spring 61 and journalled to the bed in parallel to the slide shaft 59, and an adjusting screw 64 screwable onto a screw thread 63 formed at the other end of the slide shaft 62 faces the upper surface of the bed B. When the adjusting screw 64 is rotated, the slide shaft 62 moves lengthwise and the vertically movable knife 53 moves together with the stationary knife 52, whereby the adjusting screw 64 can adjust the width of hem-stitching for the hem of a piece of cloth.

A transparent display plate 65 is fixed to the upper surface of bed B, and a fixed plate 66 is fixed below the display plate 65, and a lock screw 67 threaded into the rear of the left end of slide shaft 62 engaged at the lower end with an elongate slot 69 provided in the fixed plate 66 to thereby lock the stationary blade 52. The lock screw 67 also serves as a gauge pointer for the hem-stitch width by displaying the position of the stationary blade 52 and vertically movable blade 53 by the upper end of the lock screw 67 being visible from above through the display plate 65.

Figure 10:
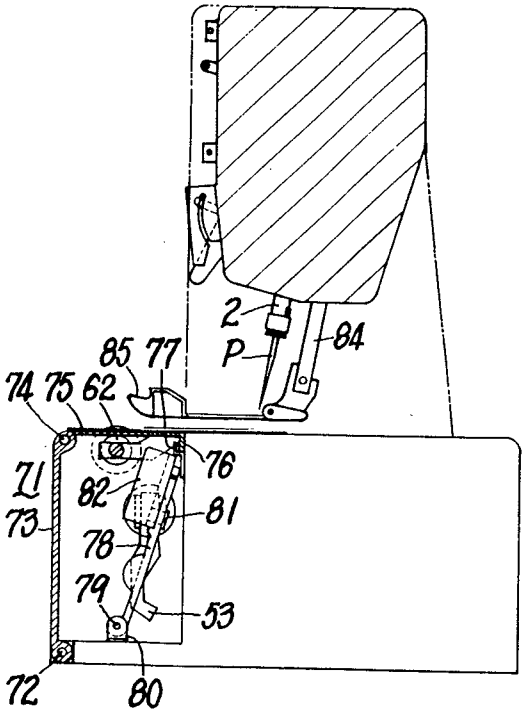
FIG. 10 is a partially cutaway side view of FIG. 9.
Figure 9:
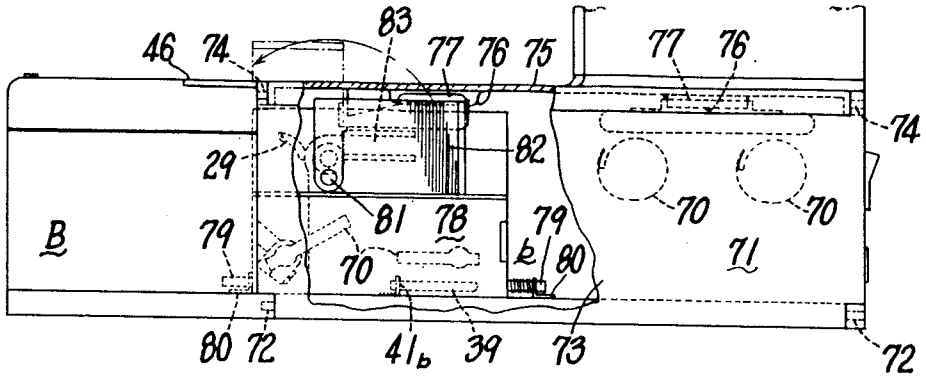
FIG. 9 is a partially cutaway front view showing a condition of a cover during use of the machine.

A bed recess b is formed rightwardly from the center of the front of bed B and has therein the upper looper 29 and lower looper 36 and the tension thread guard 70 for feeding thread to these members, a cover 71 covers the bed recess b as shown in FIGS. 9 and 10 when the composite sewing machine is used for lock stitching. The covers 71 comprise a front plate 73 supported on hinge shafts 72 at both sides on the front lower edge of the bed recess b and has a height equal to that of bed B, and an upper plate 75 supported on hinge shafts 74 at both sides of the upper edge of the front plate 73 and having a width corresponding to the depth of the bed recess b. A retainer 76 at the free end of upper plate 75 is detachably retained by a retaining edge 77 in front of the bed recess b, so that the cover 71 covers recess b during lock stitching and opens this side of the bed B and is folded in two during over-lock stitching as shown in FIG. 11.

A cut waste material removal plate 78 is provided in the bed recess b. The cut waste material removal cover 78 is inclined upwardly and is laterally slidably supported on a hinge shaft 79 at both sides of the lower edge, and shaft 79 is supported by a bearing 80 provided in the bed recess b. A covering portion 82 having a hood-like shape is provided at the free end of plate 78 and is rotatably pivoted to the plate 78 on another hinge shaft 81, so that, when over-lock stitching is performed, as shown in FIG. 11, the covering portion 82 rises to prevent the cut waste from entering bed B. A leaf spring 83 integral with the plate 78 holds the covering portion 82 in the raised state. In addition, a press rod 84 is provided inclined at an angle corresponding to the needle bar 2 at the lock stitch angle, and a cloth holder 85 is mounted on the press rod.

As seen from above, when the composite sewing machine constructed as described is used for lock stitching, the operating lever 39 for the clutch 37 of the switching means is put at the non-coupling position, the connecting pin 25 is removed from the crank 20, and the slide shaft 59 is operated to move the vertically movable blade 53 into the bed B, so that the cover 71 covers the bed recess b, whereby the composite sewing machine is usable the same as the usual zigzag sewing machine.

Figure 11:
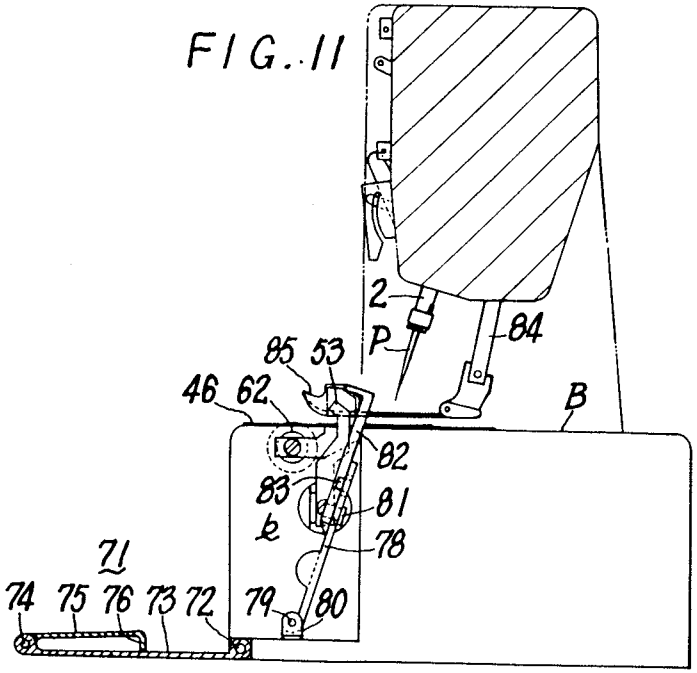
FIG. 11 is a partially cutaway side view showing a cut waste removal plate during use.

When over-lock stitching is to be performed, as shown in FIG. 11, the cover 71 is opened, the cover 78 is somewhat raised, the loop thread inserted through the tension thread guard 70 is inserted into the upper looper 39 and lower looper 36, and the cover portion 82 which has been down during the lock stitching is raised. Next, when the clutch operating lever 39 is put in the coupling position, the pin table 38 on the looper shaft 22 advances by being biased by the compression spring 40, and the connecting pin 25 couples the driven crank 23 with the crank 20. Then, when the pattern selecting cam 5*e* is rotated to the display position, the crest of the needle position converting cam 5*d* engages the switching lever 5*c*, whereby the needle bar connecting stud 3 changes the needle position rightwardly to a maximum by pivoting around fulcrum shaft 4 and the needle P moves with the needle bar 2 to the over-lock stitching seam 0. Next, when the switching cam lever 9*c* at the inclining means for the needle bar is switched upwardly, the lower end of regulating bar 9*a* is pushed out by the spring 9*b* by pivoting around the fulcrum shaft 10, and the needle bar connecting stud 3 is inclined to the over-lock stitching angle by pivoting around the second fulcrum shaft 7, so that the needle P is positioned at the predetermined needle position for over-lock stitching.

Thus, the composite sewing machine uses the upper members, such as the needle P and needle bar 2, and the lower members, such as the throat plate 46, cloth feed table 42 and feed teeth 44, for both lock stitching and for over-lock stitching, and the stitching is carried out at the same position.

The composite sewing machine of the invention constructed as described above can perform lock stitching and over-lock stitching in a range of amplitudes of the needle by motion given to the needle bar by the needle position converter, thereby enabling one needle to be used for both types of stitching. Since the upper members, such as the needle bar, etc., the lower members, such as the cloth feeder, etc., and the driving mechanism therefor are for both types of stitching, the composite sewing machine of the invention is less expensive to produce than the conventional composite sewing machine in which separate members must be provided for each type of stitching. Also, since the over-lock stitch position is adjacent to the lock stitch position, the over-lock stitching is performable substantially at the same position as the lock stitching, thereby enabling the conventional problems to be eliminated.

In the machine of the present invention, the needle bar connecting stud is provided with needle bar inclining means, separate from the needle position converter for switching the needle position laterally, and has a second fulcrum shaft so as to make it possible to longitudinally move the needle, and auxiliary means is provided for holding the needle bar connecting stud in the respective needle positions at a lock stitch angle and an over-lock stitch angle. Thus, by actuation of the needle position converter and the inclining means, the angles of needle and needle bar can be changed to be suitable for lock stitching and over-lock stitching, and the changed needle angle can be reliably maintained.

In the machine of the present invention, the inclining means for the needle bar is divided into the upper member having the fulcrum shaft for changing the needle position and the lower member connected with the upper member through the second fulcrum shaft to vertically movably support the needle bar, which makes the needle bar movable between the lock stitch angle and the over-lock stitch angle.

In the machine of the present invention, the auxiliary means holding the needle bar connecting stud at the moved position comprises guide pins projecting from vertical positions at the left-side surface of the lower member of the needle bar connecting stud, a regulating lever engaged with each guide pin and supported at the upper end on a support shaft having the axis coincided with the second fulcrum shaft and freely inclinable at the same angle as the lower member, a spring for biasing the regulating lever in the inclining direction, and a switching cam lever for holding the regulating lever at a lock stitch angle against the action of the spring, and during over-lock stitching, holding the regulating lever at the over-lock stitch angle, whereby the needle, the needle bar, and the needle bar connecting stud for vertically movably supporting the needle bar, are positively held at the lock stitch angle or the over-lock stitch angle, and the changing of the angle is facilitated.

In the machine of the present invention, the looper driving mechanism comprises a looper cam fixed to the lower member, a lifting rod fitted onto the looper cam, a crank coupled with the lifting rod through a universal joint and freely fitted onto the looper shaft, a driven crank superposed on the crank and coaxially fixed to the looper shaft, and a connecting pin slidably fitted into a connecting bore provided in parallel to and in common with the driven crank and the aforesaid crank so as to transmit swinging motion of the crank as half reciprocating rotation of the looper shaft, the clutch comprising the connecting pin, a pin support fixed at its outer end and movable along the looper shaft, and a clutch operating lever supported on the bed so as to switch the pin support and connecting pin between the coupling and non-coupling positions of the clutch, which smoothes the switching from the lock stitch condition to the over-lock stitch condition.

In the machine of the present invention, the lock stitch mechanism is provided with a zigzag stitch unit and uses on the needle position converter a needle position converting cam attached to the pattern selecting cam shaft of the zigzag stitch unit, so that a lock stitch mechanism of a conventional household sewing machine can be used in common with the over-lock stitch mechanism, thereby enabling the mechanism to be simplified and made less expensive to produce.

In the machine of the present invention, the needle is inclined to put the lower end thereof in the same position as a needle in the usual over-lock sewing machine, and to accommodate this, a throat plate, in which the needle hole for lock stitching and a needle hole for over-lock stitching are juxtaposed, is provided at the position of the rise and fall of the needle, which can keep the operation of the over-lock stitching needle smooth and at a more precise needle angle than the lock stitching in the composite sewing machine and is advantageous in that the throat plate is usable for both types of stitching.

In the machine of the present invention, at the position of rise and fall of the needle and in the vicinity of the lower looper is provided a fabric trimming knife unit comprising a stationary knife a vertically movable knife and for use during over-lock stitching, the vertically movable knife being mounted rotatably on a lift-actuating arm to be freely moved to the non-use position so as not to hinder the lock stitching. The stationary knife and vertically movable knife are mounted on a slide shaft journalled to the bed, a coil spring is fitted on the slide shaft so as to bias the vertically movable knife laterally with respect to the stationary knife, a screw thread is formed at the root of the slide shaft for the stationary knife, and an adjusting nut threaded onto the screw thread is engagable with the bed of the sewing machine, whereby a hem-stitch width adjusting unit is provided which can adjust the width of hems stitched on cloth during over-lock stitching, which makes the machine easy to use during lock stitching and also makes the composite sewing machine easy to adjust when the over-lock stitching width is changed, and simple to operate.

In the machine of the present invention, at the recess in the bed of the sewing machine in which the lower and upper loopers and a tension thread guard therefor are mounted, a cover covering these members is provided, which cover comprises a front plate having a hinge shaft at the lower edge of the front of the recess and a height equal to that of the bed and an upper plate extending from the upper edge of the front plate and being foldable around the hinge shaft and having a length corresponding to the depth of the recess in the bed, and a retainer is provided at the front end of the upper plate for detachably retaining the cover at a retaining edge provided at the front of the recess in the bed. This upper plate forms the bed surface of the composite sewing machine during lock stitching the same as the bed surface of a conventional household sewing machine, thereby making the composite sewing machine easy to use. Also, the bed surface is easily changed for lock stitching or over-lock stitching, and since the cover is foldable, there is no hindrance to the use when in over-lock stitching condition.

In the machine of the present invention, a cut waste removal plate is provided in front of the recess in the bed and a hood-like member is provided at the free end rotatably pivoted on the plate through the hinge shaft, which can cover the stitching location from above, thereby preventing the cut waste from scattering. The hood-like member can be folded down to be housed in the recess in the bed.

EFFECT OF THE INVENTION

As seen from the foregoing, the machine of the present invention is adapted to perform lock stitching and over-lock stitching by use of the same needle in the composite sewing machine provided with both the lock stitch and over-lock stitching mechanisms. The arrangement is such that the upper members, such as the needle bar connecting stud for lock stitching and the like, and the lower members, such as the throat plate and feed teeth, are usable directly for the over-lock stitching as well as for the normal lock stitching. Hence, the composite sewing machine of the invention can be made less expensively in comparison with a conventional composite sewing machine. Also, it is advantageous that the composite sewing machine is easy to use because the stitching work can be carried out at the same position.

We claim:

1. A composite sewing machine comprising:
   - a lock stitch mechanism and an over-lock stitch mechanism;
   - switching means connected to said mechanisms for switching the operation of said sewing machine between a lock stitch operation and an over-lock stitch operation;
   - a single needle carrying means;
   - a needle position converter for changing the position of the needle carrying means laterally of the stitching direction and including a needle bar connecting stud engaging the needle carrying means and a fulcrum shaft on which said stud is rotatably mounted for pivotal movement to change the vertical orientation of said needle carrying means between a lock stitch position and an over-lock stitch position which are adjacent to each other and juxtaposed laterally on said sewing machine;
   - said over-lock stitch mechanism having an upper looper and a lower looper at said over-lock stitch position;
   - a looper driving mechanism connected to said loopers and including a clutch means connecting said driving mechanism to said over-lock stitch mechanism, whereby one needle is adapted to be used for both lock stitching and over-lock stitching.

2. A composite sewing machine as claimed in claim 1 in which said needle carrying means is swingable laterally and longitudinally of the stitching direction, and said composite sewing machine further comprising a further fulcrum shaft, a needle inclining means rotatably mounted on said further fulcrum shaft, rotating means for rotating said needle inclining means, said needle inclining means being connected to said needle carrying means for, when said needle inclining means is rotated around said further fulcrum shaft, inclining said needle carrying means between the lock stitch position to a position spaced along the stitching direction, and holding means for engaging said inclining means for holding said inclining means in an inclined position.

3. A composite sewing machine as claimed in claim 2 in which said needle bar connecting stud has an upper member rotatably mounted on a still further fulcrum shaft and having said first-mentioned fulcrum shaft thereon, said firstmentioned fulcrum shaft being transverse to said still further fulcrum shaft, and a lower member pivotally mounted on said firstmentioned fulcrum shaft, whereby said lower member can be inclined in the direction of stitching, said needle inclining means being connected to said lower member.

4. A composite sewing machine as claimed in claim 3 in which said lower member has a plurality of laterally extending guide pins thereon and said needle inclining means comprises a regulating bar rotatably mounted around said further fulcrum shaft and slidably mounted on said guided pins for permitting relative lateral movement between said lower member and said regulating bar, said further fulcrum shaft being substantially coaxial with said firstmentioned fulcrum shaft, and said holding means comprises spring means biasing said regulating bar in a direction for causing said lower member to be inclined to a over-lock stitching position, and a switching cam lever engaged with said regulating bar for positioning said regulating bar against the action of said spring means at an angular position corresponding to a desired inclined position of the lower member for a desired over-lock stitching position along the direction of stitching.

5. A composite sewing machine as claimed in claim 1 in which said sewing machine has a lower shaft driver from the driving means for the respective stitching mechanisms, and said looper driving mechanism comprises a looper cam on said lower shaft, a lifting rod fitted onto said looper cam, a universal joint on said lifting rod, a crank connected to said lifting rod through said universal joint, a looper shaft along which said crank is freely movable, a driven crank adjacent said crank, and said clutch means includes pin means slidably engagable with said cranks for coupling them for rotation around said looper shaft, a pin support on which said pin means is mounted and movable along said looper shaft, and a clutch operating lever supported on said sewing machine for moving said pin support back and for to engage and disengage said cranks with and from each other.

6. A composite sewing machine as claimed in claim 1 in which said lock stitch mechanism includes a zigzag stitching means and said needle position converter includes a needle position supporting cam engaged with said needle bar connecting stud and driven from a pattern selecting cam in said zigzag stitching means.

7. A composite sewing machine as claimed in claim 1 in which said sewing machine has a thread plate at the stitching position of said sewing machine having a needle hole therein at a lock stitch position through which a needle on said needle carrying means moves when said sewing machine is in the lock stitch operating condition and having a further hole therein laterally juxtaposed to said firstmentioned needle hole at an over-lock stitch position through which a needle on said needle carrying means moves when said sewing machine is in the over-lock stitch operating condition.

8. A composite sewing machine as claimed in claim 1 further comprising a first fabric trimming knife adjacent the over-lock stitch position, a first slide shaft on which said first fabric trimming knife is slidably mounted for lateral adjustment of the position of said first fabric trimming knife, an adjusting nut threadedly mounted on said first slide shaft for adjusting the position of said shaft for lateral adjustment of the position of said first fabric trimming knife, a second fabric trimming knife adjacent the over-lock stitch position and cooperating with said first fabric trimming knife for trimming fabric edges to be over-lock stitched, a second slide shaft on which said second fabric trimming knife is slidably rotatably mounted for rotating said second fabric trimming knife knife from a raised position adjacent the over-lock stitch position to a retraced position spaced away from said over-lock stitch position.

9. A composite sewing machine as claimed in claim 1 in which said sewing machine has a bed having a recess beneath said lock stitch and said over-lock stitch positions and in which said lower looper and said upper looper are positioned, said recess opening upwardly and laterally of said bed, and a cover for closing the upward and lateral opening of said recess, said cover having a front member for closing said lateral opening and hinged to said bed at the lower end of said cover for swinging downwardly and outwardly of said bed, and an upper member for closing the upward opening and hinged to the upper end of said front member and having a retainer at the opposite end thereof from the hinged connection to said front member and engagable with said bed for retaining said cover in position, said upper member being foldable against the inside face of said front member when said front member is swung downwardly and outwardly of said bed.

10. A composite sewing machine as claimed in claim 9 further comprising a cut waste removal plate mounted in said recess for movement between a retracted position in said recess and an extended position over said over-lock stitch position to block cut waste from the fabric trimming operations from reaching other parts of said sewing machine.

* * * * *